US011410828B2

(12) United States Patent
Geier et al.

(10) Patent No.: US 11,410,828 B2
(45) Date of Patent: Aug. 9, 2022

(54) X-RAY SOURCE DEVICE COMPRISING AN ANODE FOR GENERATING X-RAYS

(71) Applicant: Siemens Healthcare GmbH, Erlangen (DE)

(72) Inventors: Felix Geier, Erlangen (DE); Oliver Heuermann, Adelsdorf (DE); Jan Matschulla, Oderwitz (DE); Karin Soeldner, Schwaig (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 105 days.

(21) Appl. No.: 17/076,939

(22) Filed: Oct. 22, 2020

(65) Prior Publication Data

US 2021/0272765 A1 Sep. 2, 2021

(30) Foreign Application Priority Data

Feb. 28, 2020 (DE) ..... 10 2020 202 585.1

(51) Int. Cl.
*H01J 35/10* (2006.01)

(52) U.S. Cl.
CPC ..... *H01J 35/101* (2013.01); *H01J 2235/104* (2013.01)

(58) Field of Classification Search
CPC ..... H01J 35/101; H01J 2235/104
See application file for complete search history.

(56) References Cited

U.S. PATENT DOCUMENTS 4,500,142 A 2/1985 Brunet
5,506,881 A * 4/1996 Ono ..... H01J 35/104 378/131
2013/0208871 A1* 8/2013 Baral ..... H01J 35/1017 378/144

FOREIGN PATENT DOCUMENTS

DE 10 2011 081 280 A1 2/2013
DE 10 2018 201 394 B3 5/2019

* cited by examiner

*Primary Examiner* — Chih-Cheng Kao
(74) *Attorney, Agent, or Firm* — Harness, Dickey & Pierce, P.L.C.

(57) ABSTRACT

An x-ray source device includes an anode for generating x-rays via an electron beam striking a focal point of the anode, the anode being rotatable about an axis of rotation via an electric motor including a stator and a rotor, the stator including a first coil end, relatively nearer to the anode and a second coil end, relatively further from the anode. A laminated core of the stator is arranged between the first and second coil ends. The first coil end includes a first intersection area, relatively further from the focal point and a second intersection area, relatively nearer to the focal point, with respect to the focal plane. A maximal external radius of the second intersection area is relatively smaller than a maximal external radius of the laminated core in the focal plane.

20 Claims, 4 Drawing Sheets

X-RAY SOURCE DEVICE COMPRISING AN ANODE FOR GENERATING X-RAYS

PRIORITY STATEMENT

The present application hereby claims priority under 35 U.S.C. § 119 to German patent application number DE 102020202585.1 filed Feb. 28, 2020, the entire contents of which are hereby incorporated herein by reference.

FIELD

Embodiments of the invention generally relate to an x-ray source device comprising an anode for generating x-rays.

BACKGROUND

X-ray source devices are used for medical and non-medical applications and serve as a source for x-rays for illumination or scattering on objects to be examined.

An x-ray source device is generally known. Reference can be made purely by way of example to DE 10 2011 081 280 A1 and to U.S. Pat. No. 4,500,142 A.

During operation of an x-ray source device, an electron beam which is directed at an anode is generated via a cathode. The point at which the electron beam strikes is referred to as the focal spot or focal point. The x-ray radiation is generated in the focal point.

The electron beam heats up the focal point. In order to prevent the focal point from overheating, the anode is often embodied as a rotary anode, which is rotated about a rotary axis or axis of rotation during operation. The rotation is brought about via an electric machine or an electric motor, the rotor of which together with the rotary anode is arranged inside of a vacuum container and is connected in a torque proof manner thereto and the stator of which is arranged outside of the vacuum container.

For optimal imaging it is necessary for the focal point, with respect to the x-ray source device which does not rotate in its entirety about the axis of rotation, to be as static as possible, i.e. stationary, in other words not to move or at least only to move minimally during operation of the x-ray source device.

Since the electron beam generating the x-ray radiation can be influenced by electromagnetic fields, it is therefore necessary to keep the influence of electromagnetic fields, such as occurs for instance in electric motors or electric machines, as constant as possible.

An important influencing factor are the scatter fields which originate from the stator while the rotor is being driven. These scatter fields can cause movements of the focal point, which viewed both in the direction about the axis of rotation and also orthogonally hereto, i.e. in the radial direction in relation to the axis of rotation, can lie in the range of several 100 μm. The interferences and errors caused in the process during the imaging are often not negligible but are at least disadvantageous and restrict the resolution of the x-ray system.

DE 10 2011 081 280 A1 discloses embodying the coil system of the stator as a yoke coil. With a coil system of this type, it is possible for the focal point to move by less than approx. 50 μm both in the direction viewed about the axis of rotation and also orthogonally hereto. However, a yoke coil is laborious in terms of manufacture and therefore cost-intensive.

It was also proposed to reduce or even completely interrupt the application of current to the coil system of the stator during the active operation of the x-ray source device, while the x-ray radiation is therefore emitted. This procedure results however in a significantly reduced movement of the focal point, but is not always practical, however.

In particular, with an embodiment of the bearing of the rotary anode as a slide bearing, the frictional forces within the bearing are too high, so that with a complete interruption in the power supply, the rotational movement of the rotary anode would decline too quickly or the rotational speed of the anode would drop too quickly.

The patent application DE 10 2018 201 394 B3, the entire contents of which are hereby incorporated herein by reference, moreover discloses that the coil system has coils, the individual windings of which overlap a number of stator teeth in each case, and that the stator is embodied so that when the individual phases are applied with the same phase voltages, the phases in each case induce magnetic scatter fields of the same size. This is an advantageous possibility of keeping the focal point as stationary as possible.

SUMMARY

However, the inventors have discovered that even with this procedure, the focal point can still not be kept spatially constant to ensure that this is adequate for particularly high-resolution x-ray imaging.

At least one embodiment of this application specifies an x-ray source device, which further improves the resolution for the x-ray imaging.

At least one embodiment of this application is directed to an x-ray source device, comprising:

an anode, to generate x-rays upon an electron beam striking a focal point of the anode, the anode being rotatable about an axis of rotation via an electric motor including a stator and a rotor, the stator including a first coil end, relatively nearer to the anode in a direction of the axis of rotation, and a second coil end, relatively further from the anode in the direction of the axis of rotation, wherein a laminated core, included in the stator, is arranged between the first coil end and the second coil end, the laminated core, in a radial direction in relation to the axis of rotation, including a maximal external radius in a focal plane, wherein the focal plane includes the focal point and the axis of rotation, wherein the first coil end includes a first intersection area, relatively further from the focal point and a second intersection area, relatively nearer to the focal point, with respect to the focal plane, and wherein a maximal external radius of the second intersection area is relatively smaller than a maximal external radius of the laminated core in the focal plane

BRIEF DESCRIPTION OF THE DRAWINGS

Example embodiments of the invention are explained in more detail schematically below on the basis of the figures, in which.

Provided the same reference characters are used in the various FIGS. 1 to 5, the same reference characters refer to the same components.

DETAILED DESCRIPTION OF THE EXAMPLE EMBODIMENTS

Figure 1:
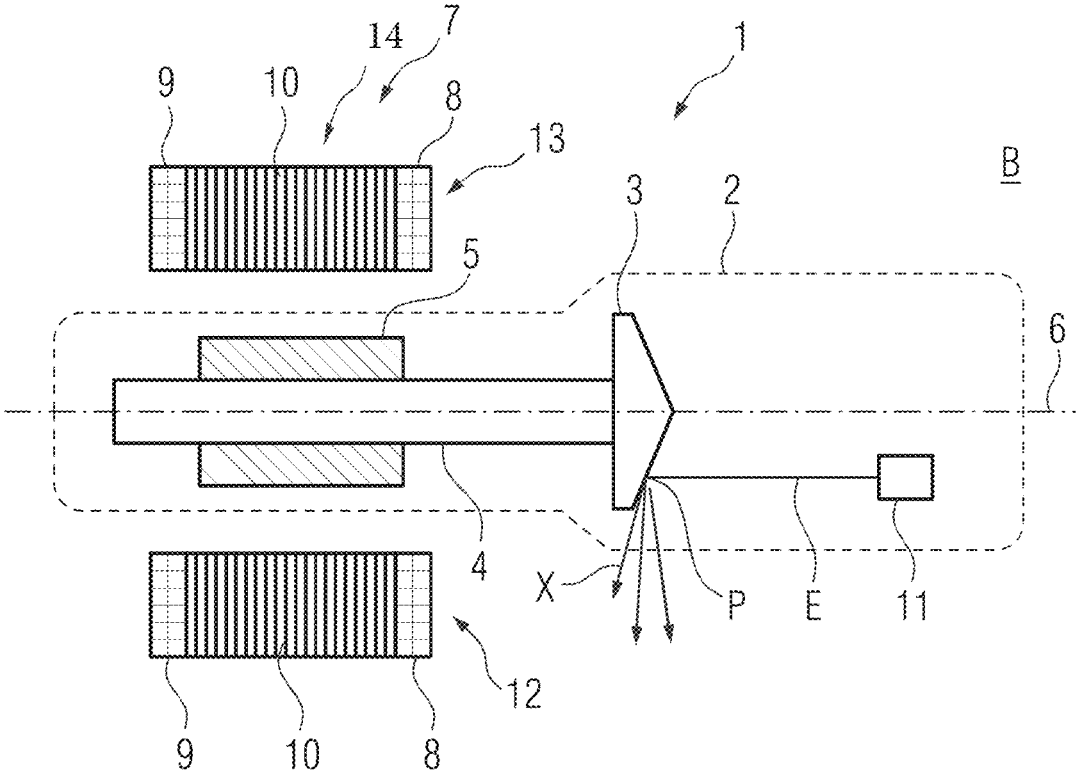
FIG. 1 shows a schematic representation of an x-ray source arrangement with electric motor for operating a rotary anode.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuity such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

Specifically, a first coil end, relatively nearer to the anode, is sometimes referenced only as first coil end and is further sometimes used synonymously with a coil end, which is close the anode. Specifically, a second coil end, relatively further from the anode, is sometimes referenced only as second coil end and is further sometimes used synonymously with coil end, which is remote the anode.

Additionally, a first intersection area, relatively further from the focal point with respect to the focal plane, is sometimes referenced as a first intersection area and is further sometimes used synonymously with an intersection area which is remote from the focal point. Additionally, a second intersection area, relatively nearer to the focal point with respect to the focal plane, is sometimes referenced as a second intersection area and is further sometimes used synonymously with an intersection area which is close to the focal point.

At least one embodiment is directed to an x-ray source device. The x-ray source device includes an anode for generating x-rays by way of an electron beam striking a focal point of the anode. The anode is rotatable about an axis of rotation via an electric motor, which comprises a stator and a rotor. The rotor is preferably connected to the anode in a torque-proof manner. The stator has a coil end, which is close to the anode, in the direction of the axis of rotation and a coil end, which is remote from the anode, in the direction of the axis of rotation.

A laminated core included in the stator is arranged between the coil end, which is close to the anode, and the coil end, which is remote from the anode. A focal plane comprises the focal point and the axis of rotation. In the focal plane, in particular on the side facing the coil end, which is close to the anode, the laminated core has a maximal external radius. The coil end, which is close to the anode, has an intersection area, which is remote from the focal point, and an intersection area, which is close to a focal point, with the focal plane and a maximal external radius of the intersection area, which is close to the focal point, of the coil end, which is close to the anode, is smaller than the maximal external radius of the laminated core in the focal plane.

Via an x-ray source device configured in this way, it is possible to reduce the electromagnetic scatter fields in particular via the geometric embodiment of the coil end, which is close to the anode, in the vicinity of the focal point or at the focal point itself. This results in a surprisingly significant reduction in the focal point movement both in the peripheral direction about the axis of rotation and also radially in relation to the axis of rotation.

In a particularly advantageous embodiment, the scatter fields are reduced essentially to zero via the geometric embodiment of the coil end, which is close to the anode, so that this no longer results in a constant interference but instead in no interference in the electron beam at the focal point or in the vicinity of the focal point.

On account of the increased spatial constancy of the focal point, the geometric mapping ratios for the focal point and the imaging geometry are more constant than in the prior art and the image quality of the entire x-ray device can be improved via an x-ray source device of this type.

It this teaching is combined with the known teaching DE 10 2018 201 394 B3 (the entire contents of which are hereby incorporated herein by reference), the focal point movement in the radial and peripheral direction, based on the achievable results with the teaching DE 10 2018 201 394 B3, can be reduced by the factor 2.

The coil end is formed from the coils included in the stator. A stator generally comprises two coil ends, a first coil end, which is arranged on the anode side and thus close to the anode. The second coil end is arranged on the side of the stator facing away from the anode and is thus remote from the anode. A laminated core is arranged between the coil end, which is close to the anode, and the coil end which is remote from the anode. The coil end which is close to the anode and remote from the anode and the laminated core are generally fixed relative to one another, for instance by way of injection.

The external radius of the laminated core in the focal plane is as a rule essentially constant. If this is not constant, the external radius of the sheet of the laminated core, which is closest to the coil end, which is close to the anode, in the focal plane or a number of adjacent sheets, e.g. the next three or five adjacent sheets is to be used in the form of an external radius average value for the current technical teaching.

The rotor can be made to rotate in a rotational movement about the axis of rotation by way of the current flow through the coils of the stator. Since the anode is connected to the rotor in a torque-proof manner, the rotor movement results in an anode rotational movement.

The focal plane is formed from the focal point and the axis of rotation. The focal plane covered in this way is therefore generally at a right angle to a plane perpendicular to the axis of rotation. The focal plane therefore intersects the stator.

Since the focal point is generally at a distance from the axis of rotation of the anode, in particular does not lie in the point of intersection of the axis of rotation and anode, but instead on the anode away from the axis of rotation, there is an intersection area, which is close to the focal point, of the coil end, which is close to the anode, and an intersection area, which is remote from the focal point, of the coil end, which is close to the anode, with the focal plane. The intersection area, which is close to the focal point, of the coil end, which is close to the anode, is of interest to the invention since its scatter fields influence an incident electron beam at most.

The intersection area of the coil end, which is close to the anode, with the focal plane can be considered to be an intersection surface through the coil end along the focal plane. The intersection area, which is close to the focal point, of the coil end, which is close to the anode, therefore generally forms the cross-section of the coil end at the part of the coil end, which is close to the anode, which is closest to the focal point.

The region, which is close to the focal point, of the coil end, which is close to the anode, which is in particular at least +/−20° in the peripheral direction about the axis of rotation relative to the focal plane, is preferably dimensioned geometrically so that the magnetic scatter field at the site of the focal point is smaller than the scatter field emanating from a region, which is remote from the anode, of the coil end, which is close to the anode, for the focal point reflected on the axis of rotation.

In one embodiment of the invention, the ratio from the difference of the maximal external radius of the intersection area, which is close to the focal point, and the maximal internal radius of the laminated core and the difference between the external radius of the laminated core and the maximal internal radius of the laminated core is smaller than or equal to 0.9, in particular smaller than or equal to 0.75, preferably smaller than or equal to 0.5. These are advantageous ratios, which the smaller the ratio, provide a smaller scatter field in the region of the focal point. Basically, the further the external radius of the laminated core projects from the external radius of the coil end, which is close to the anode, in the intersection area, which is close to the focal point, the more advantageously therefore the scatter field is embodied in respect of influencing the electron beam or the focal point movement properties.

In a further embodiment of the invention, the stator has coils comprising a number of, in particular three, phases, wherein one of the coiled phases in the region of the intersection area, which is close to the focal point, viewed radially outward, has at least two windings which in the direction of the laminated core embody two converging limbs. The limbs are preferably formed in each case from several windings. The structure of the coil end, which is close to the anode, embodied by way of the limbs, can also be referred to as V-type, wherein a contact point of the limbs of the "V"-type structure need not absolutely be present. The opening of the limbs in the direction of the anode keeps the current-conducting windings remote from the focal point, so that the scatter fields are reduced, in particular the scatter fields caused by the diverging windings between the windings mutually cancel each other out.

In particular, the first and the second limbs can form an opening angle of 165° to 60°, in a preferred embodiment the opening angle amounts to 140° to 90°, in particular 120° to 90°. This is a simple and effective manner of reducing the effect of the scatter field of the coil end, which is close to the anode, to an incident electron beam and thus of locally stabilizing the focal point.

In a further embodiment of the invention, a point of intersection of the limbs is arranged in the region of the intersection area, which is close to the focal point. The point of intersection can be virtual, i.e. can exist as a result of an imaginary extension of the two limbs in the longitudinal extension direction. The point of intersection can also exist as a contact point or crossing point of two windings of the two limbs which are the closest facing one another and converge. A point at which the two closest facing and converging windings of the two limbs cross would be understood to mean a crossing point, in other words a first of the two windings overruns the other winding.

The region of the intersection area, which is close to the focal point, extends in the peripheral direction of the coil end about the axis of rotation. In the context of the technical teaching, one region of the intersection area, which is close to the focal point, is then only still present if the position of the point of intersection still results in a reduction in the scatter field. The region preferably extends about +/−5 degrees in the peripheral direction of the coil end, which is close to the anode, about the axis of rotation relative to the focal point, possibly even more. In a special embodiment, the point of intersection lies in the focal plane.

In a further embodiment of the invention, the coil comprising the at least two windings, in the region of the intersection area, which is close to the focal point, forms a radially outer-lying coil of the coil end, in particular the radially outer-lying coil of the coil end. By this coil forming the radially outer-lying coil, i.e. in the region of the intersection area, which is close to the focal point, the windings of these coils have a larger radial distance from the axis of rotation compared with the windings of the coil of the other phases, a v-type limb structure can be realized effectively. This change in the radial geometric dimensions of the coil end, which is close to the anode, enables a corresponding scatter field reduction. In this context radially outer can also be understood to mean the radially outermost winding.

In a further embodiment of the invention, the coil comprising the at least two windings is guided radially inward in the region of the intersection area, which is close to the focal point, on the side of the coil end facing the laminated core. Therefore the part of the coil which lies closer to the point of intersection or the laminated core, on the side of the coil end, which is close to the anode, facing the laminated core is guided to teeth and grooves in the laminated core, on which the coil is coiled. This is similarly a practically simple option of realizing a v-type shape of the radially outer coil.

According to a further embodiment of the invention, the external radius of the intersection area, which is close to the focal point, in a perpendicular plane at right angles to the axis of rotation forms a minimal external radius and the external radius of the coil end, which is close to the anode, enlarges in the peripheral direction about the axis of rotation to a maximal external radius. The perpendicular plane can also be considered to be an end face of the stator, wherein this intersects the stator at the height of the coil end, which is close to the anode. A coil end with "dent", which is close to the anode, is therefore achieved in the angular range of the coil end, which is close to the anode and which has the smallest distance from the focal point. The angular range, across which the maximal external radius in the focal plane enlarges to a maximal external radius outside of the focal plane in the peripheral direction, is preferably embodied in symmetry with the focal plane.

In the peripheral direction about the axis of rotation, the external radius of the coil end, which is close to the anode, but adjacent to the focal plane, therefore increases, in particular as a far as a maximum value, which is then essentially constant in the peripheral direction. The scatter fields are therefore reduced in the relevant region, which has the smallest distance from the focal point, but at the same time the coils of all phases can be accommodated in the coil end, which is close to the anode.

The external radius of the intersection area, which is close to the focal point, advantageously enlarges within an angular range in the peripheral direction by less than +/−45°, in particular less than +/−30°, in particular less than +/−20°, in particular less than +/−10° based on the intersection area, which is close to the focal point.

In another example embodiment of the invention, on an inner surface facing the axis of rotation the laminated core has grooves and teeth in the peripheral direction for receiving coils, wherein at least one groove which is adjacent to the intersection area, which is close to the focal point, is free of a coil. A number of grooves adjacent to the intersection area, which is close to the focal point, can advantageously also be free of coils, in particular the plurality of grooves which are free of coils can be arranged in symmetry with the intersection area, which is close to the focal point, so that the same number of grooves remain free in the peripheral direction in a positive and negative direction of rotation along the periphery.

In particular, the grooves can form a maximal internal radius of the stator and the teeth can form a minimal internal radius of the stator.

The phases are wound onto the grooves and teeth. By at least one groove adjacent to the intersection area, which is close to the focal point, preferably two or more grooves adjacent to the intersection area, which is close to the focal point, being unwound, windings are displaced away from the intersection area, which is close to the focal point. As a result, the influence of the scatter field on an incident electron beam is further reduced.

In another example embodiment, on an inner surface facing the axis of rotation the laminated core has grooves and teeth in the peripheral direction for receiving coils, wherein the focal plane intersects a tooth, which is close to the focal point, wherein in the peripheral direction about the axis of rotation the tooth has an extension of at least +/−5° in relation to the focal plane. The tooth of the stator is therefore dimensioned with the smallest distance from the focal point so that the coils or the windings are arranged comparatively far from the focal point. In this way the influence of the scatter field on an incident electron beam is further reduced.

FIG. 1 shows a schematic representation of an x-ray source device 1, for instance for use for medical imaging or in the industrial environment.

The x-ray source device 1 comprises a vacuum container 2, which is evacuated at least during operation of the x-ray source device.

An anode 3 and a cathode 11 is arranged within the vacuum container 2. An electron beam, which strikes the anode 3, is generated during operation of the x-ray source device 1 with the aid of the cathode 11. The point of impact of the electron beam is referred to as focal point P. The focal point P is available, irrespective of whether or not the x-ray source device 1 is in operation.

If an electron beam E strikes the focal point P, the anode 3 therefore emits x-rays X.

The anode 3 is currently embodied as a rotary anode, in order to reduce the thermal load on the anode 3. The anode 3 is connected to a rotor 5 via a shaft 4, said rotor interacting via a stator 7 arranged outside of the vacuum container 2, so that during operation the rotor 5 rotates about an axis of rotation 6.

During operation, in other words with a rotating anode 3, a focal "ring" forms on the rotating anode 3, whereas from the point of view of a stationary external reference system, the focal point P is essentially stationary, but is exposed to the influence of possible magnetic scatter fields.

The focal point P and the axis of rotation 6 together define the focal plane B. The representation in FIG. 1 shows a schematic section of the x-ray source device 1 in the focal plane B.

The stator 7 currently has a coil end 8 and a coil end 9. In the direction of the axis of rotation 6 the coil end 8 is arranged closer to the anode 3 than the coil end 9, the coil end 8 is therefore referred to as a coil end 8, which is close to the anode and the coil end 9 is referred to as a coil end 9 which is remote from the anode.

Furthermore, the stator 7 comprises a laminated core 10, which comprises individual sheets arranged one behind the other in the direction of the axis of rotation 6. The individual sheets are configured in the shape of a ring and thus together form a hollow cylinder-type laminated core 10.

The laminated core 10 has teeth and grooves on its radially inner-lying surface, which are not shown in FIG. 1. The coils 14 are guided via these teeth and grooves.

The coil ends 8 or 9 are used to combine the coils 14 guided from the radially inner-lying surface and escaping at the first and last sheet in the direction of the axis of rotation.

With respect to the anode 3, the coil end 8, which is close to the anode, has two intersection areas 12 and 13 in the focal plane B. In FIG. 1 the intersection area 12 is closer to the focal point P than the intersection area 13, i.e. has a smaller distance herefrom. Therefore the intersection area 12 is referred to as an intersection area 12, which is closer to the focal point, and the intersection area 13 is referred to as an intersection area 13, which is remoter from the focal point.

In the known systems, the coil ends combine the coils more or less irregularly. Finally, the spatial compactness of the stator and position of the electrical terminal of the coils on the power supply are paramount with respect to the stop position of the stator. This nevertheless results in disadvantageous geometric shapes, in particular of the coil end, with respect to the scatter fields generated hereby, which act on the focal point.

Figure 2:
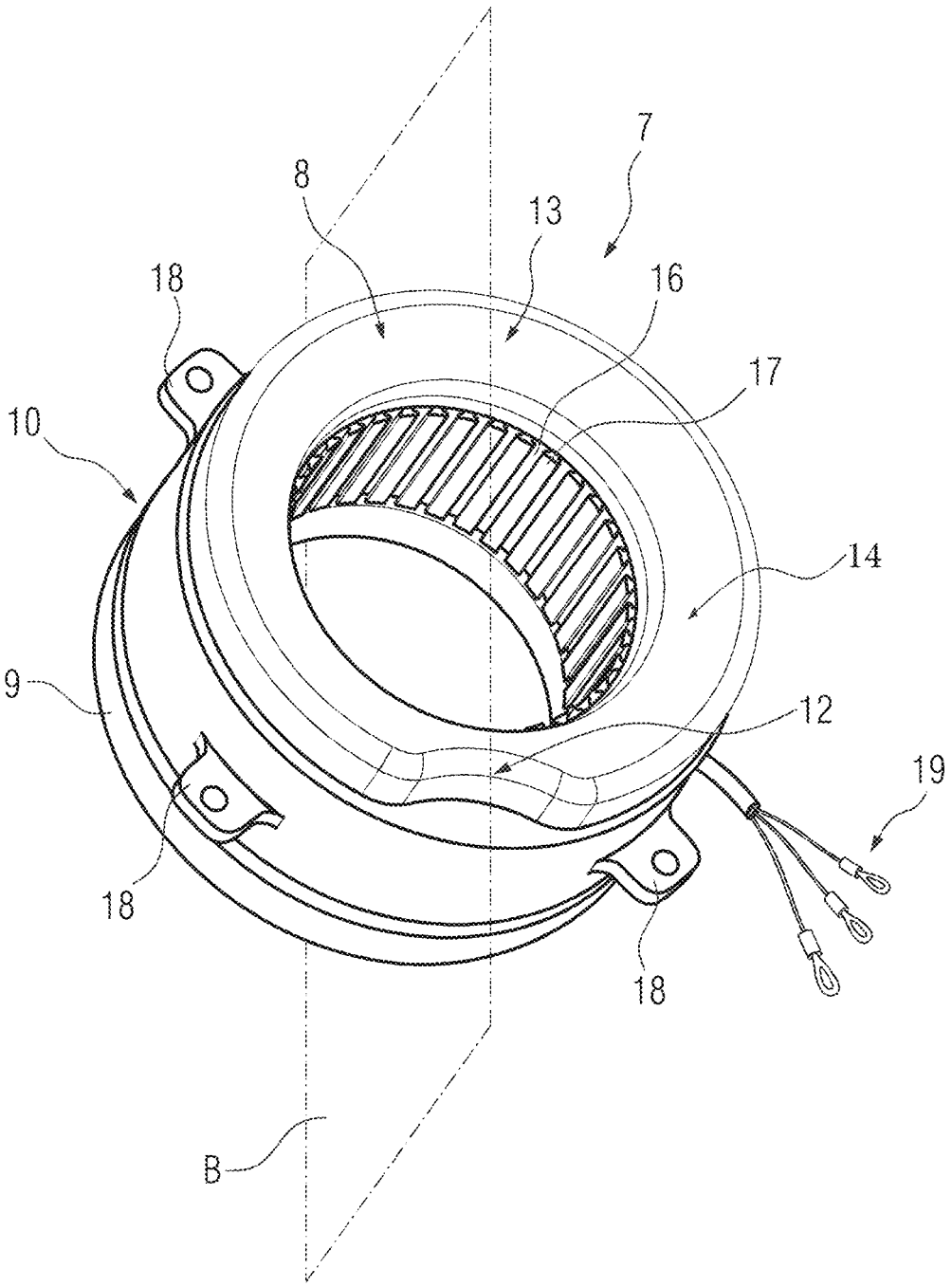
FIG. 2 shows a schematic spatial view of an example stator.

FIG. 2 shows a schematic spatial view of an example stator 7, as can be used in FIG. 1. This comprises the coil end 9, which is remote from the anode, the coil end 8, which is close to the anode, and the laminated core 10 arranged between the coil ends 8 and 9.

The stator 7 has a number of fastening facilities 18, e.g. in the form of fastening lugs distributed equidistantly on the periphery in the peripheral direction. The stator 7 is fixed with this relative to the axis of rotation 5.

Furthermore, the stator 7 has three separate coils, which are assigned in each case to one of three phases. The coils are not shown in FIG. 2 for the sake of clarity, however. During operation the coils of the three phases are supplied with power by way of the respective phase terminal 19. It can also be provided more or less as three separate coils.

Furthermore, the inner radial surface of the laminated core 10 can be seen in FIG. 2. In the peripheral direction about the axis of rotation the laminated core 10 has teeth 17 which extend parallel to the axis of rotation, in the form of webs. Grooves 16 which guide the coils or conductors of the coils which are not shown in FIG. 2 are arranged therebetween.

The coil end 8, which is close to the anode, or the coil end 9, which is remote from the anode, are shown as a uniform block for the sake of simplicity, but in reality have a plurality of conductors and no blocky appearance.

FIG. 2 shows a reduction in a maximal external radius of the coil end 8 for the coil end 8, which is close to the anode. The external radius of the coil end 8, which is close to the anode, is determined on the side of the coil end 8, which faces the anode during operation.

The minimum of the maximal external radius in the peripheral direction about the axis of rotation is located in a region of the coil end 8 which is close to the focal point when the stator 7 is installed. I.e. the minimum of the maximal external radius is preferably arranged in an angular range of +/−5 degrees relative to the focal plane B.

In the present example embodiment, the minimum of the external radius of the region of the coil end 8, which is close to the focal point, is arranged particularly advantageously in the focal plane B. The maximal external radius of the intersection area 12, which is close to the focal point, of the coil end 8, which is close to the anode, is smaller than the maximal external radius of the laminated core 10 in the focal plane B which adjoins the coil end 8, which is close to the anode.

FIG. 2 shows the overhang of the laminated core 10 beyond the external radius of the coil end 8, which is close to the anode, at any position at which the coil end 8 has a radial "dent" in the peripheral direction. This "dent" extends in the peripheral direction about the axis of rotation over an angular range of less than $60^2$, in particular approx. 45°, and thus +/−30°, in particular +/−22.5° relative to the focal plane B on the side of the coil end 8, which is close to the anode, which faces the anode during operation.

By way of this geometric deformation of the coil end 8, which is close to the anode, the scatter fields of the stator 7 are reduced at the focal point, as a result of which the spatial stability of the focal point is increased during operation of the x-ray source device.

Figure 3:
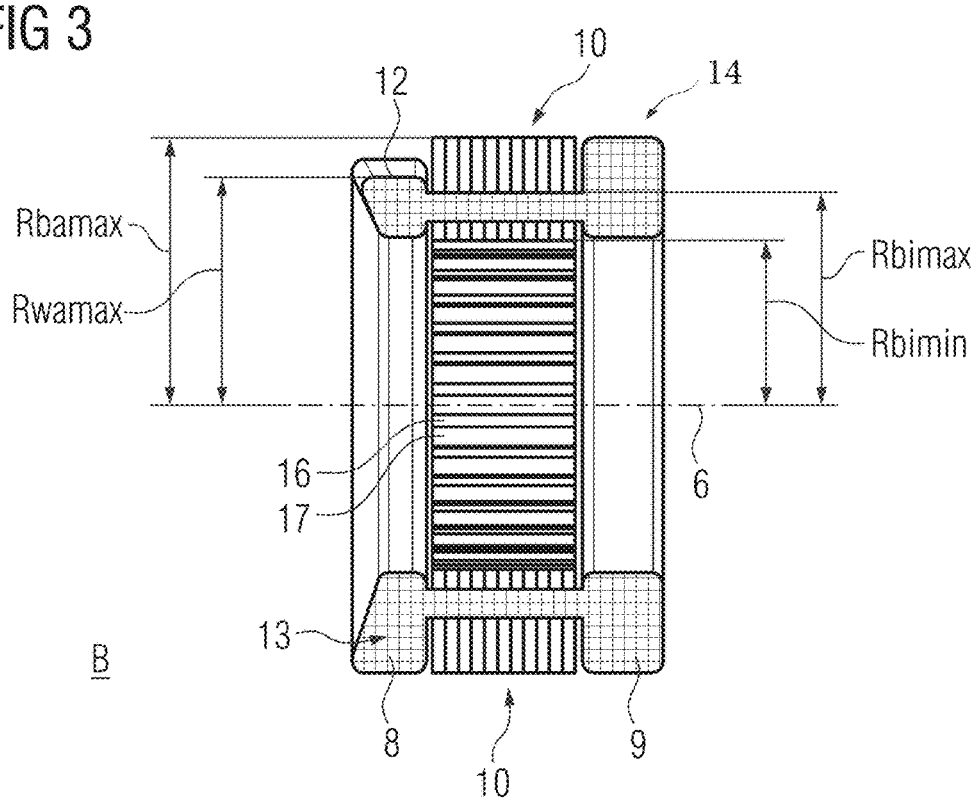
FIG. 3 shows a sectional representation of an example stator in the focal plane.

FIG. 3 shows a schematic sectional view of the example stator 7 in the focal plane B. Here the coil end 8, which is close to the anode, is arranged adjoining the laminated core 10 to the left, when observed in a correct orientation in FIG. 2, while the coil end 9, which is remote from the anode, is arranged to the right of the laminated core 10.

The embodiments according to FIG. 2 apply similarly to the "blocky" representation of the coil end 8 or 9 in FIG. 3. This serves only for the simplified representation.

Relevant radii are shown in FIG. 3. In particular, the maximal external radius $Rba_{max}$ of the laminated core 10, the maximal external radius $Rwa_{max}$ of the coil end 8, which is close to the anode, are shown in particular in the intersection area 12, which is close to the focal point. Furthermore, the maximal internal radius $Rbi_{max}$ of the laminated core 10 is shown, which corresponds essentially to the radial distance of the surface, facing the axis of rotation 6, from a groove of the axis of rotation 6.

Furthermore, the minimal internal radius $Rbi_{min}$ of the laminated core 10 is shown, which corresponds essentially to the radial distance of the surface of a tooth facing or oriented toward the axis of rotation 6 and the axis of rotation 6.

The above radii $Rba_{max}$, $Rwa_{max}$, $Rbi_{max}$ are preferably to be determined in the focal plane. If this is not possible, the respective relevant radius, which is not realized in the focal plane, $Rbi_{max}$ and $Rbi_{min}$ are considered here in particular, is to be determined immediately in the vicinity of the focal plane where it occurs next to the focal plane.

It is also clear again from FIG. 3 that the maximal external radius $Rwa_{max}$ of the intersection area 12, which is close to the focal point, of the coil end 8, which is close to the anode, is selected to be smaller than the maximal external radius $Rba_{max}$ of the laminated core 10.

Figure 4:
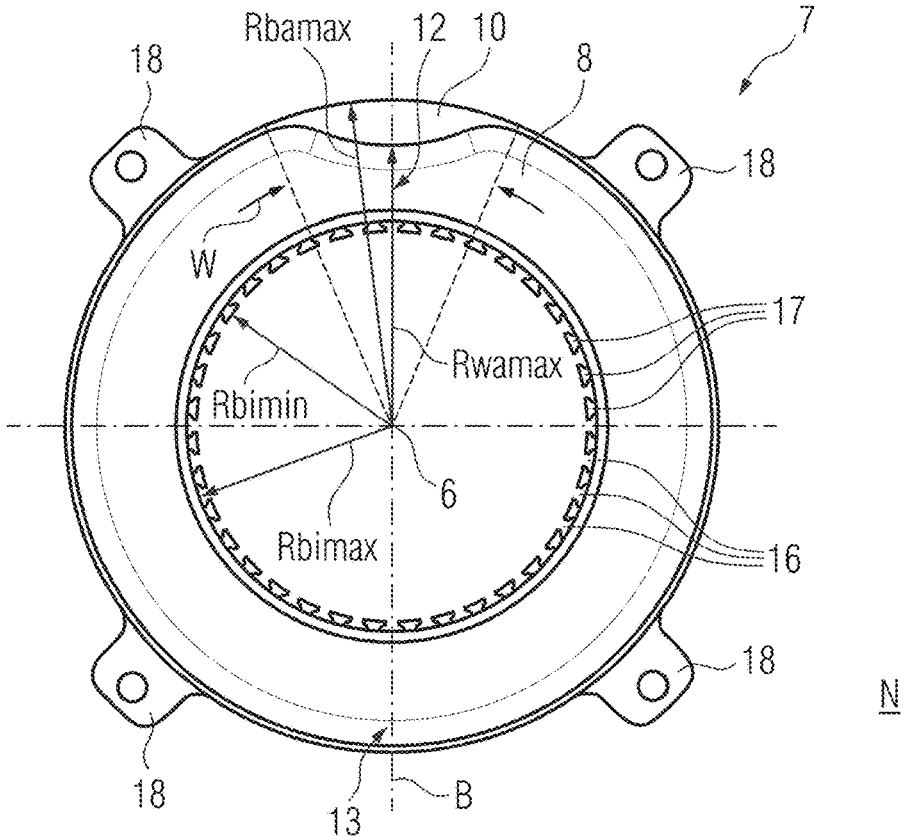
FIG. 4 shows a schematic view at right angles to the axis of rotation on an example coil end, which is close to the anode, of a stator.

FIG. 4 shows a schematic view of the stator 7 in a plane N at right angles to the axis of rotation 6. Here the coil end 8, which is close to the anode, can be seen in the foreground in FIG. 4.

The radial dimensioning signs inserted in FIG. 3 are reproduced again for the purpose of clarity in FIG. 4. The axis of rotation 6 runs through the center point of the view of the stator 7 shown. The coil end, which is remote from the anode, is not shown in FIG. 4.

The radial inner surface of the laminated core 10 can be seen from FIG. 4. This has a plurality of teeth 17 and grooves 16 in the peripheral direction about the axis of rotation 6, which guide the windings.

In FIG. 4 the region, which is close to the focal point, of the coil end 8, which is close to the anode, in particular the intersection area 12, which is close to the focal point, when considered with a correct orientation in FIG. 4, is arranged in the upper part of FIG. 4 and the intersection area 13, which is remote from the focal point, is arranged in the lower part of FIG. 4. Furthermore FIG. 4 shows an angular region W in the peripheral direction within which the maximal external radius $Rwa_{max}$ of the coil end 8 is smaller than the maximal external radius $Rba_{max}$ of the adjoining laminated core 10.

In particular, the ratio of $(Rwa_{max}-Rbi_{max})/(Rba_{max}-Rbi_{max})$ amounts to less than 0.9, preferably less than 0.75 or less than 0.5. In one particular embodiment, the ratio can also be zero. In the case "zero", a part or the entire angular range W is free of coils 14.

Alternatively, the dimensions of the teeth 17, in particular in the vicinity of the intersection are 12, which is close to the focal point, can be selected so that these are comparatively large. On account of the suitable dimensions of the teeth, the coils have a greater distance from the intersection area 12, which is close to the focal point, as a result of which the scatter fields of the coil end 8 are reduced at the site of the focal point. For instance, the teeth 17 can cover an angular range of 10° in the peripheral direction, in symmetry with the focal plane B therefore +/−5°.

Figure 5:
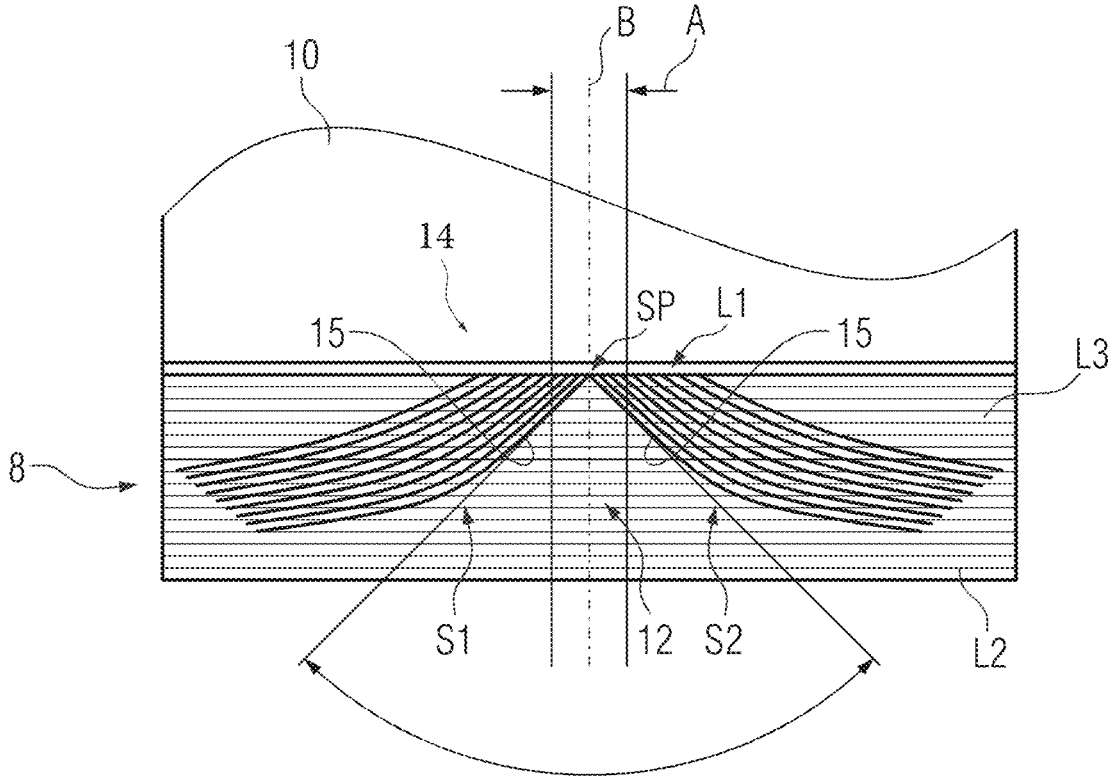
FIG. 5 shows a view radially outward onto an example v-type winding area of a coil end, which is close to the anode.

FIG. 5 shows a top view onto a coil end 8, which is close to an anode, of a stator 7 in the region of the intersection area 12, which is close to the focal point, from radially outside. Here the distance of the observer is greater than the maximal external radius of the laminated core 10.

The stator 7 comprises three coils, which are assigned to three different phases L1, L2 and L3 and which are wound offset by 120° onto the stator 7. In FIG. 5 the two phases L2 and L3 are not shown distinguishable, but in FIG. 5 form the visible segment of the coil end 8.

The coils 14 of the stator 7 take place so that in the region of the intersection area 12, which is close to the focal point, the coil of the phase L1 forms the radially outer lying coil. Furthermore, the coil of the phase L1 in this region runs from the radially inner surface of the laminated core 10, on the side of the coil end 8 facing the laminated core 10, to the radially outer position of the coil end 8, which is close to the anode.

Here the coil of the phase L1 is guided so that viewed in the region of the intersection area 12, which is close to the focal point, from the laminated core 10, this diverges in a v-shape or viewed in the reverse direction converges in a v-shape on the sheet side. The phase coil L1 therefore has windings 15, which have a first limb S1 and a second limb S2.

By diverging the conductors, there is a tendency for the magnetic field generated by the windings 15 to cancel out between the diverging limbs S1 or S2. The scatter field in the focal point range is therefore reduced during operation of the x-ray source device.

FIG. 5 shows a point of intersection SP, where the two windings 15 touch. This is not obligatory, however; it is sufficient if the limbs S1 and S2 converge in the direction of the laminated core 10, without touching. In this case, these form a virtual point of intersection SP. These can cross uniformly at a point of intersection SP.

FIG. 5 also shows an opening angle formed by the limbs S1 and S2. This is preferably smaller than 160° and 60°, in particular between 140° and 90° or between 120° and 90°. The opening angle is preferably determined by the middle course of the windings 15 of the x-type structure. Here the region, which is close to the point of intersection, is more significant than the region which is remote from the point of intersection.

The point of intersection SP can be arranged within the focal plane B; this is advantageous for reasons of symmetry. It is sufficient, however, if the point of intersection SP is arranged within a distance A/2 from the focal plane B, which still results in a reduction in the scatter field in the focal point. In particular, A can be selected so that this corresponds to an angular range of less than +/5°, in particular less than +/−2.5°, relative to the focal plane B.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An x-ray source device, comprising:

an anode, to generate x-rays via an electron beam striking a focal point of the anode, the anode being rotatable about an axis of rotation via an electric motor including a stator and a rotor, the stator including a first coil end, relatively nearer to the anode in a direction of the axis of rotation, and a second coil end, relatively further from the anode in the direction of the axis of rotation, wherein a laminated core, included in the stator, is arranged between the first coil end and the second coil end, the laminated core, in a radial direction in relation to the axis of rotation, including a maximal external radius in a focal plane, wherein the focal plane includes the focal point and the axis of rotation, wherein the first coil end includes a first intersection area, relatively further from the focal point and a second intersection area, relatively nearer to the focal point, with respect to the focal plane, and wherein a maximal external radius of the second intersection area is relatively smaller than a maximal external radius of the laminated core in the focal plane.

2. The x-ray source device of claim 1, wherein a ratio from a difference of the maximal external radius of the second intersection area and a maximal internal radius of the laminated core in the focal plane, and a difference in an external radius of the laminated core and the maximal internal radius of the laminated core in the focal plane is less than or equal to 0.9.

3. The x-ray source device of claim 2, wherein the ratio is less than or equal to 0.75.

4. The x-ray source device of claim 3, wherein the ratio is less than or equal to 0.5.

5. The x-ray source device of claim 2, wherein the stator includes a plurality of coiled phases, wherein one of the coiled phases, in a region of the second intersection area includes, viewed radially outwards, at least two windings, which, in a direction of the laminated core, embody two limbs which converge.

6. The x-ray source device of claim 5, wherein a point of intersection of the two limbs is arranged in the region (A) of the second intersection area.

7. The x-ray source device of claim 5, wherein the coil from one of the coiled phases, including the at least two windings in the region of the second intersection area, embodies a radially outer-lying coil of the first coil end.

8. The x-ray source device of claim 1, wherein the stator includes coils from a plurality of coiled phases, wherein a coil of one of the coiled phases, in a region of the second intersection area includes, viewed radially outwards, at least two windings, which, in a direction of the laminated core, embody two limbs which converge.

9. The x-ray source device of claim 8, wherein a point of intersection of the two limbs is arranged in the region (A) of the second intersection area.

10. The x-ray source device of claim 9, wherein the coil from one of the coiled phases, including the at least two windings in the region of the second intersection area, embodies a radially outer-lying coil of the first coil end.

11. The x-ray source device of claim 9, wherein the coil from one of the coiled phases, including the at least two windings, is guided radially inward in the region of the second intersection area, on a side of the first coil end, facing the laminated core.

12. The x-ray source device of claim 8, wherein the coil from one of the coiled phases, including the at least two windings in the region of the second intersection area, embodies a radially outer-lying coil of the first coil end.

13. The x-ray source device of claim 12, wherein the coil from one of the coiled phases, including the at least two windings, is guided radially inward in the region of the second intersection area, on a side of the first coil end, facing the laminated core.

14. The x-ray source device of claim 8, wherein the coil from one of the coiled phases, including the at least two windings, is guided radially inward in the region of the second intersection area, on a side of the first coil end, facing the laminated core.

15. The x-ray source device of claim 1, wherein the external radius of the second intersection area, in a perpendicular plane at right angles to the axis of rotation, forms a minimal external radius and wherein the external radius of the first coil end, enlarges in a peripheral direction about the axis of rotation.

16. The x-ray source device of claim 15, wherein the external radius of the first coil end, enlarges in a peripheral direction about the axis of rotation on both sides of the focal plane.

17. The x-ray source device of claim 1, wherein the external radius of the first coil end, enlarges in an angular range of less than
+/−45°, in the peripheral direction relative to the focal plane.

18. The x-ray source device of claim 17, wherein the external radius of the first coil end, enlarges in an angular range of less than +/−20°, in the peripheral direction relative to the focal plane.

19. The x-ray source device of claim 1, wherein the laminated core includes grooves and teeth in the peripheral direction on an inner surface facing the axis of rotation, and wherein at least one groove of the grooves, adjacent to the second intersection area, is free of a coil.

20. The x-ray source device of claim 1, wherein on an inner surface facing the axis of rotation, the laminated core includes grooves and teeth in the peripheral direction, and wherein the focal plane intersects a tooth of the teeth, relatively closest to the focal point, wherein the tooth, in the peripheral direction about the axis of rotation, has an extension of at least +/−2.5° in relation to the focal plane.

* * * * *